US009953776B2

(12) United States Patent
Liao et al.

(10) Patent No.: US 9,953,776 B2
(45) Date of Patent: Apr. 24, 2018

(54) KEYSWITCH

(71) Applicant: DARFON ELECTRONICS CORP., Taoyuan (TW)

(72) Inventors: Pen-Hui Liao, Taoyuan (TW); Chin-Hung Lin, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 0 days.

(21) Appl. No.: 15/485,234

(22) Filed: Apr. 12, 2017

(65) Prior Publication Data

US 2017/0330707 A1 Nov. 16, 2017

(30) Foreign Application Priority Data

May 13, 2016 (TW) ..... 105114902 A

(51) Int. Cl.
*H01H 36/00* (2006.01)
*H01H 13/14* (2006.01)
(Continued)

(52) U.S. Cl.
CPC ..... *H01H 13/14* (2013.01); *H01H 3/122* (2013.01); *H01H 3/125* (2013.01); *H01H 13/84* (2013.01);
(Continued)

(58) Field of Classification Search
CPC ..... H01H 36/00; H01H 36/0073; H01H 36/0006; H01H 5/02; H01H 2003/506; H01H 2001/545; H01H 36/002; H01H 36/008; H01H 9/443; H01H 13/85; H01H 13/7065; H01H 3/125; H01H 13/705
(Continued)

(56) References Cited

U.S. PATENT DOCUMENTS 7,449,651 B2 * 11/2008 Lin ..... H01H 3/125 200/344
7,683,280 B2 * 3/2010 Hsu ..... H01H 3/125 200/344
(Continued)

FOREIGN PATENT DOCUMENTS

CN 102364653 A 2/2012
CN 202523582 U 11/2012
(Continued)

*Primary Examiner* — Ahmed Saeed
(74) *Attorney, Agent, or Firm* — Winston Hsu

(57) ABSTRACT

A keyswitch includes a base plate, a cap having a longitudinal axis, a returning device, a support mechanism, and a lifting mechanism including first and second support plates. The first support plate has first and second edges parallel to the longitudinal axis for respectively abutting against the base plate and the cap. The second support plate has third and fourth edges parallel to the longitudinal axis for respectively abutting against the base plate and the cap. The base plate is disposed through openings of the first and second support plates to make the first and second support plates movably connected to the base plate. The returning device drives the cap to a non-pressed position with rotation of the first and second support plates. The support mechanism has first and second support members pivoted to each other to be movably connected to the cap and the base plate.

11 Claims, 9 Drawing Sheets

(51) Int. Cl.
*H01H 3/12* (2006.01)
*H01H 13/84* (2006.01)

(52) U.S. Cl.
CPC ..... *H01H 36/0073* (2013.01); *H01H 2221/04* (2013.01)

(58) Field of Classification Search
USPC ..... 335/205–207
See application file for complete search history.

(56) References Cited

U.S. PATENT DOCUMENTS

| | | | | |
|---|---|---|---|---|
| 8,970,331 | B2 * | 3/2015 | Chang | H01H 13/702 200/341 |
| 2014/0034468 | A1 * | 2/2014 | Krumpelman | H01H 3/122 200/5 A |

FOREIGN PATENT DOCUMENTS

| | | | |
|---|---|---|---|
| CN | 103065842 | A | 4/2013 |
| CN | 204991565 | U | 1/2016 |
| TW | M504996 | U | 7/2015 |
| TW | 201608586 | A | 3/2016 |

* cited by examiner

KEYSWITCH

BACKGROUND OF THE INVENTION

1. Field of the Invention

The present invention relates to a keyswitch, and more specifically, to a keyswitch utilizing a support mechanism located between a first support plate and a second support plate to be movably connected to a cap and a base plate for increasing a pull-out force of the cap.

2. Description of the Prior Art

A keyboard, which is the most common input device, can be found in variety of electronic apparatuses for users to input characters, symbols, numerals and so on. Furthermore, consumer electronic products and industrial machine tools are all equipped with a keyboard for performing input operations.

A stroke of a cap of a conventional keyswitch is relatively long, so it is easy to dispose a rubber dome under the cap so that when the cap is pressed to move downward, the rubber dome is deformed and produces resilient force, and when the cap is released, the resilient force drives the cap to move upward to its original position. However, with a tendency toward keyboard miniaturization, the stroke of the cap is required to decrease, so the height of the rubber dome is also required to decrease. The service life and the resilient force of the keyswitch decays with a decreasing height of the rubber dome. Furthermore, for a keyswitch with a longer length (or called a multiple-width keyswitch), a plurality of links is disposed under the cap so that the cap can remain horizontally while being moved up and down by a user pressing any portion of the cap, and the user can feel a distinct force feedback (or tactile feedback). However, if the height of the cap is required to decrease more, the aforesaid design may not be accomplished easily due to space constraint. Moreover, the aforesaid link connection design can also reduce the pull-out force of the cap to cause the problem that the cap could fall off easily.

SUMMARY OF THE INVENTION

The present invention provides a keyswitch. The keyswitch includes a base plate, a cap, a lifting mechanism, a returning device, and at least one support mechanism. The cap has a longitudinal axis. The lifting mechanism is disposed between the base plate and the cap. The cap is movable between a pressed position and a non-pressed position relative to the base plate via the lifting mechanism. The lifting mechanism includes a first support plate and a second support plate coupled to each other. The first support plate has at least one first opening. The base plate is partially disposed through the at least one first opening to make the first support plate movably connected to the base plate. The first support plate has a first edge and a second edge. The first edge abuts against the base plate. The second edge is opposite to the first edge and abuts against the cap. The first edge and the second edge are parallel to the longitudinal axis. The second support plate has at least one second opening. The base plate is partially disposed through the at least one second opening to make the second support plate movably connected to the base plate. The second support plate has a third edge and a fourth edge. The third edge abuts against the base plate. The fourth edge is opposite to the third edge and abuts against the cap. The third edge and the fourth edge are parallel to the longitudinal axis. The returning device is located between the first support plate and the second support plate for providing a returning force to drive the cap to move from the pressed position back to the non-pressed position with rotation of the first support plate relative to the base plate via the first edge and rotation of the second support plate relative to the base plate via the third edge. The at least one support mechanism is located between the first support plate and the second support plate. The at least one support mechanism has a first support member and a second support member. The first support member is movably connected to the cap and the base plate. The second support member is movably connected to the cap and the base plate and is pivoted to the first support member.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
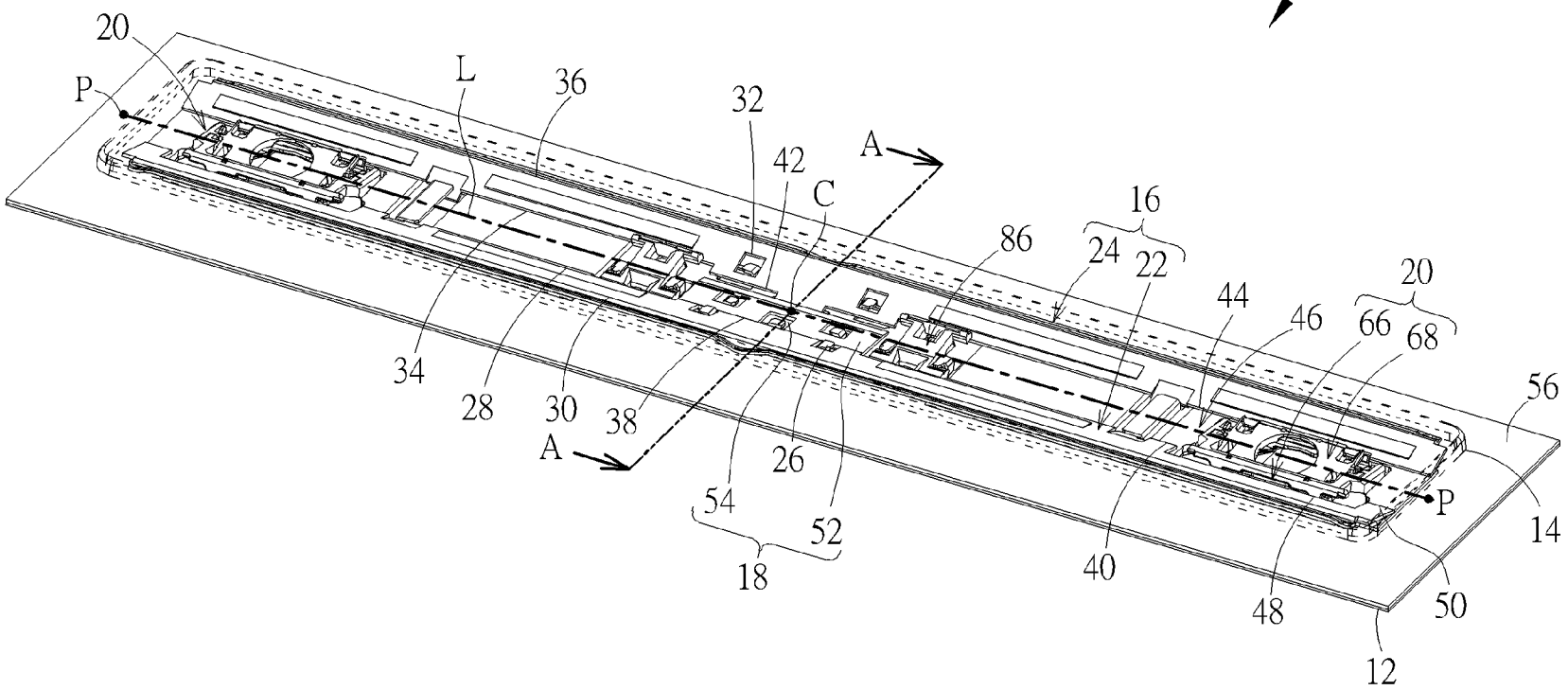
FIG. 1 is a diagram of a keyswitch according to an embodiment of the present invention.

Please refer to FIG. 1, which is a diagram of a keyswitch 10 according to an embodiment of the present invention. For clearly showing the internal mechanical design of the keyswitch 10, a cap 14 is depicted by dotted lines in FIG. 1. As shown in FIG. 1, the keyswitch 10 could preferably be a keyswitch with a longer length (also called a multiple-width keyswitch) and includes a base plate 12, the cap 14, a lifting mechanism 16, a returning device 18, and at least one support mechanism 20 (two shown in FIG. 1, but not limited thereto). The cap 14 has a longitudinal axis L. The lifting mechanism 16 is disposed between the base plate 12 and the cap 14. The cap 14 can move between a pressed position and a non-pressed position relative to the base plate 12 via the lifting mechanism 16. The lifting mechanism 16 includes a first support plate 22 and a second support plate 24. The first support plate 22 and the second support plate 24 are coupled to each other. The first support plate 22 has at least one first opening 26 (five shown in FIG. 1, but not limited thereto). The base plate 12 is partially disposed through the first opening 26 to make the first support plate 22 movably connected to the base plate 12. The first support plate 22 has a first edge 28 and a second edge 30. The first edge 28 abuts against the base plate 12 to make the first support plate 22 rotatable relative to the base plate 12 via the first edge 28. The second edge 30 is opposite to the first edge 28 and abuts against the cap 14. The first edge 28 and the second edge 30 are parallel to the longitudinal axis L to make the first support plate 22 strip-shaped. The second support plate 24 has at least one second opening 32 (two shown in FIG. 1, but not limited thereto). The base plate 12 is partially disposed through the second opening 32 to make the second support plate 24 movably connected to the base plate 12. The second support plate 24 has a third edge 34 and a fourth edge 36. The third edge 34 abuts against the base plate 12 to make the second support plate 24 rotatable relative to the base plate 12 via the third edge 34. The fourth edge 36 is opposite to the third edge 34 and abuts against the cap 14. The third edge 34 and the fourth edge 36 are parallel to the longitudinal axis L to make the second support plate 22 strip-shaped.

To be more specific, the first edge 28 could have a first middle section 38 and a first tail section 40. The first middle section 38 is close to a center point C of the longitudinal axis L. The first tail section 40 is close to a terminal point P of the longitudinal axis L. The third edge 34 could have a second middle section 42 and a second tail section 44. The second middle section 42 is close to the center point C of the longitudinal axis L. The second tail section 44 is close to the terminal point P of the longitudinal axis L. The first tail section 40 is away from the second tail section 44 forming a containing space 46. The support mechanism 20 is disposed in the containing space 46. In practical application, the first support plate 22 could further have a containing slot 48 and an auxiliary edge 50 corresponding to the support mechanism 20. The support mechanism 20 is partially contained within the containing slot 48. The auxiliary edge 50 extends outwardly from the containing slot 48 to be located at an outer side of the support mechanism 20 away from the returning device 18 and abuts against the base plate 12. Accordingly, the first support plate 22 can rotate steadily relative to the base plate 12 via the first edge 28 and the auxiliary edge 50 to improve the tactile feedback of the keyswitch 10.

Figure 2:
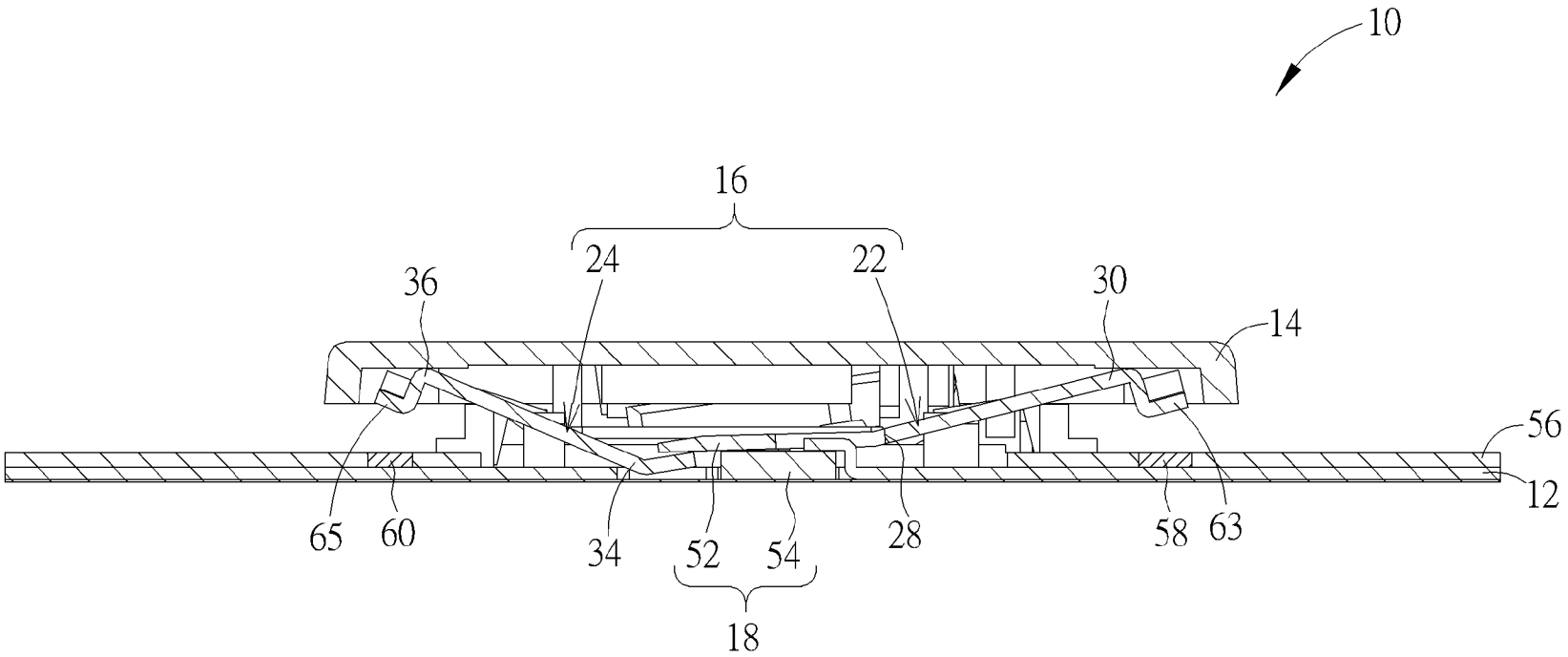
FIG. 2 is a cross-sectional diagram of the keyswitch in FIG. 1 along a cross-sectional line A-A.
Figure 3:
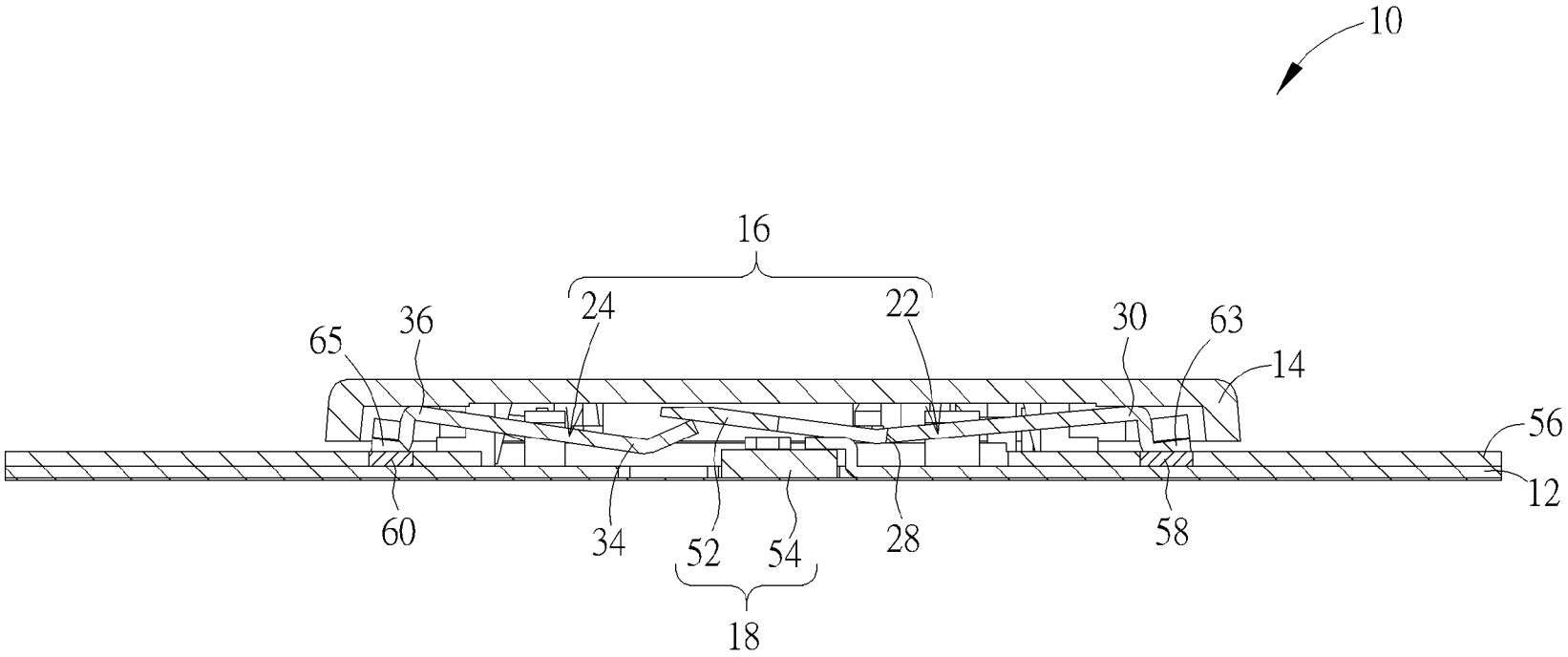
FIG. 3 is a cross-sectional diagram of a cap in FIG. 2 being pressed to a pressed position.

The returning device 18 is located between the first support plate 22 and the second support plate 24 for providing a returning force to drive the cap 14 to move from the pressed position back to the non-pressed position with rotation of the first support plate 22 relative to the base plate 12 via the first edge 28 and rotation of the second support plate 24 relative to the base plate 12 via the third edge 34. In this embodiment, the returning device 18 could preferably adopt the magnetic attraction design. For example, please refer to FIG. 1, FIG. 2, and FIG. 3. FIG. 2 is a cross-sectional diagram of the keyswitch 10 in FIG. 1 along a cross-sectional line A-A. FIG. 3 is a cross-sectional diagram of the cap 14 in FIG. 2 being pressed to the pressed position. As shown in FIG. 1, FIG. 2, and FIG. 3, the returning device 18 includes a first magnetic member 52 and a second magnetic member 54. The first magnetic member 52 extends from the first edge 28 toward the second support plate 24. The second magnetic member 54 is disposed on the base plate 12 corresponding to the first magnetic member 52. Accordingly, the first magnetic member 52 can magnetically attract the second magnetic member 54 to generate the returning force. When the cap 14 is not pressed, the returning force keeps the cap 14 at the non-pressed position as shown in FIG. 2. When the cap 14 is pressed by an external force to make the first magnetic member 52 separate from the second magnetic member 54 with rotation of the first support plate 22 relative to the base plate 12 via the first edge 28, the cap 14 moves from the non-pressed position as shown in FIG. 2 to the pressed position as shown in FIG. 3 with the lifting mechanism 16 performing the triggering operation to execute a corresponding input function. On the other hand, when the external force is released, the returning force makes the first magnetic member 52 return to be adjacent the second magnetic member 54. Accordingly, the cap 14 could move from the pressed position as shown in FIG. 3 back to the non-pressed position as shown in FIG. 2 with the lifting mechanism 16, so that the cap 14 could automatically return to its original position.

Figure 4:
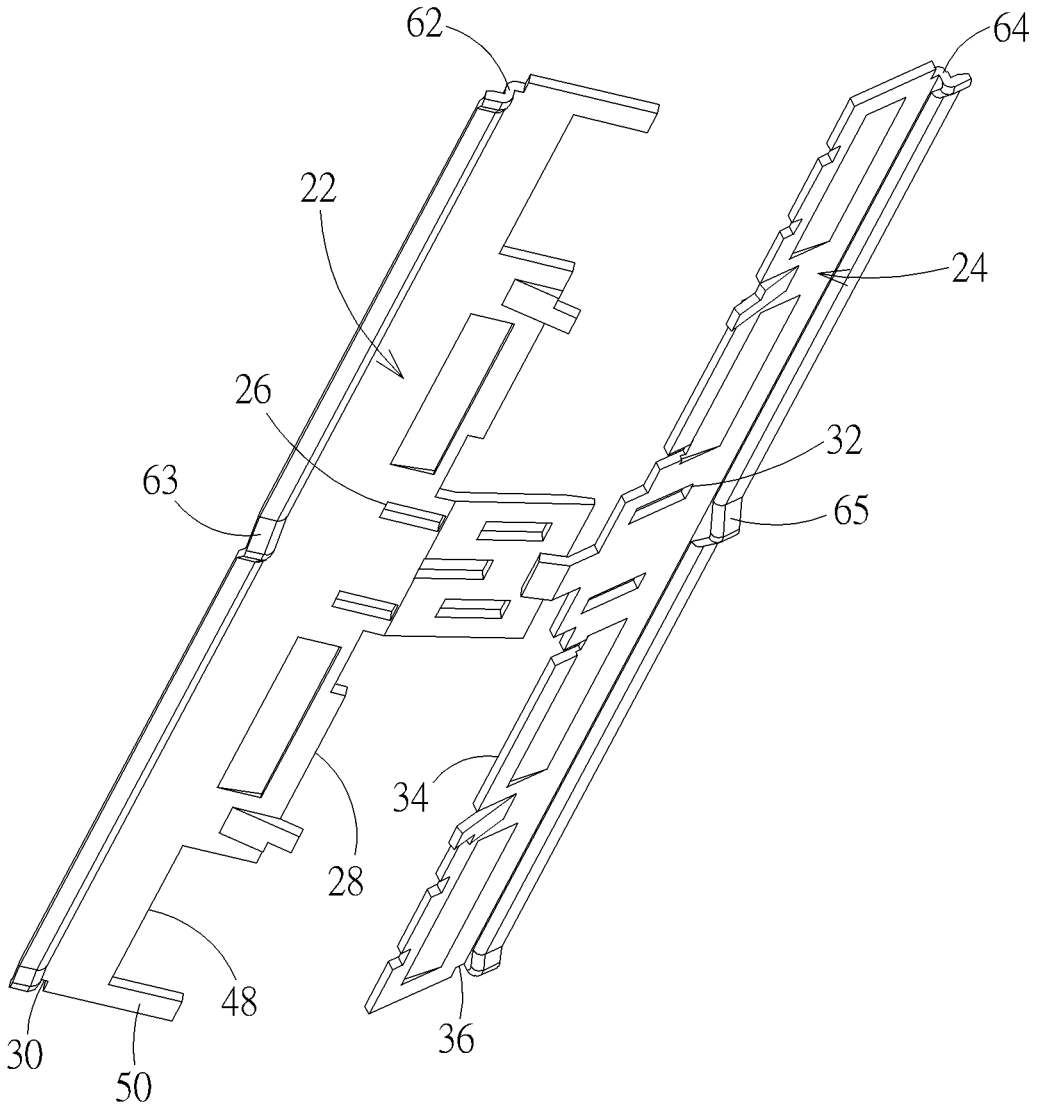
FIG. 4 is an enlarged diagram of a first support plate and a second support plate in FIG. 1 from another viewing angle.

Please refer to FIGS. 1-4. FIG. 4 is an enlarged diagram of the first support plate 22 and the second support plate 24 in FIG. 1 from another viewing angle. As shown in FIGS. 1-4, the keyswitch 10 could further include a membrane circuit board 56. The membrane circuit board 56 is disposed on the base plate 12 and has at least one first triggering switch 58 (one shown in FIG. 2, but not limited thereto) corresponding to the second edge 30 and at least one second triggering switch 60 (one shown in FIG. 2, but not limited thereto) corresponding to the fourth edge 36. In practical application, for making the cap 14 capable of triggering the first triggering switch 58 and the second triggering switch 60 surely, the second edge 30 could have at least one first bending structure 62 (one shown in FIG. 4, but not limited thereto), and the fourth edge 36 could have at least one second bending structure 64 (one shown in FIG. 4, but not limited thereto). The first bending structure 62 has a first protruding portion 63 corresponding to the first triggering switch 58, and the second bending structure 64 has a second protruding portion 65 corresponding to the second triggering switch 60. In such a manner, when the cap 14 moves to the pressed position as shown in FIG. 3 relative to the base plate 12 via the lifting mechanism 16, the first protruding portion 63 presses the first triggering switch 58 and the second protruding portion 65 presses the second triggering switch 60 for triggering the membrane circuit board 56 to complete the triggering operation for executing a corresponding input function.

Figure 5:
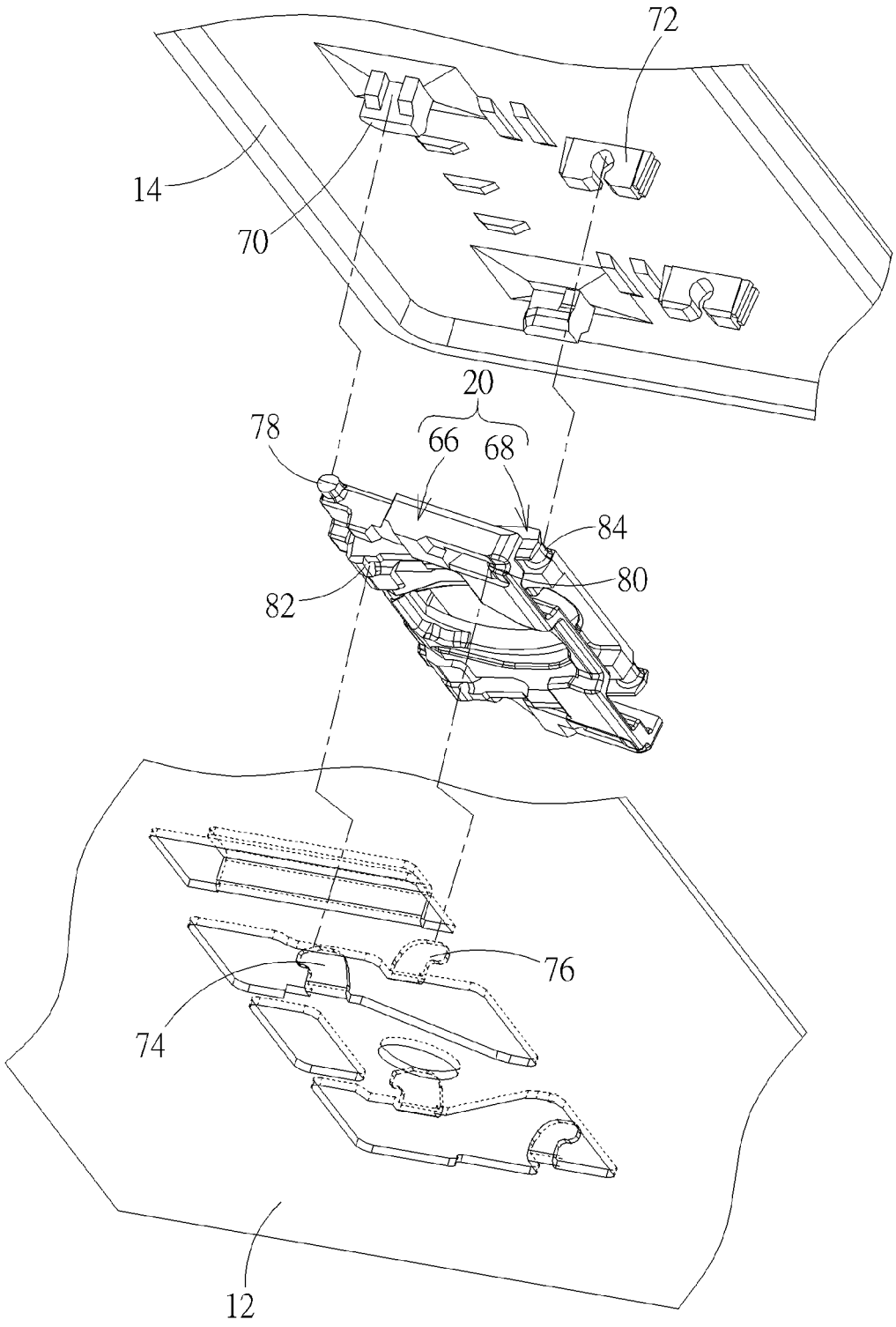
FIG. 5 is an exploded diagram of a base plate, the cap, and a support mechanism in FIG. 1.

The support mechanism 20 is located between the first support plate 22 and the second support plate 24. The support mechanism 20 could have a first support member 66 and a second support member 68. The first support member 66 is movably connected to the cap 14 and the base plate 12. The second support member 68 is movably connected to the cap 14 and the base plate 12 and is pivoted to the first support member 66. To be more specific in this embodiment, the support mechanism 20 could preferably adopt a scissor support design, and the related description could be as shown in FIG. 1 and FIG. 5. FIG. 5 is an exploded diagram of the base plate 12, the cap 14, and the support mechanism 20 in FIG. 1, and the base plate 12 and the cap 14 are partially depicted in FIG. 5. As shown in FIG. 1 and FIG. 5, the cap 14 could have a first sliding slot 70 and a first engaging slot 72. The base plate 12 could have a second sliding slot 74 and a second engaging slot 76. The first support member 66 could have a first sliding portion 78 and a first pivot portion 80. The first sliding portion 78 is slidably disposed in the first sliding slot 70, and the first pivot portion 80 is rotatably connected to the second engaging slot 76. The second support member 68 could have a second sliding portion 82 and a second pivot portion 84. The second sliding portion 82 is slidably disposed in the second sliding slot 74, and the second pivot portion 84 is rotatably connected to the first engaging slot 72. In such a manner, during the cap 14 moves between the non-pressed position and the pressed position as shown in FIG. 3, the aforesaid connection design could generate the effect that a edge of the cap 14 close to the terminal point P of the longitudinal axis L could move together with a center portion of the cap 14 close to the center point C via the first support member 66 and the second support member 68. Furthermore, the aforesaid connection design could also increase the pull-out force of the cap 14 via connection of the first sliding portion 78 and the first sliding slot 70 and connection of the second pivot portion 84 and the first engaging slot 72 to efficiently solve the prior art problem that the cap of the conventional multiple-width keyswitch could fall off easily.

Figure 6:
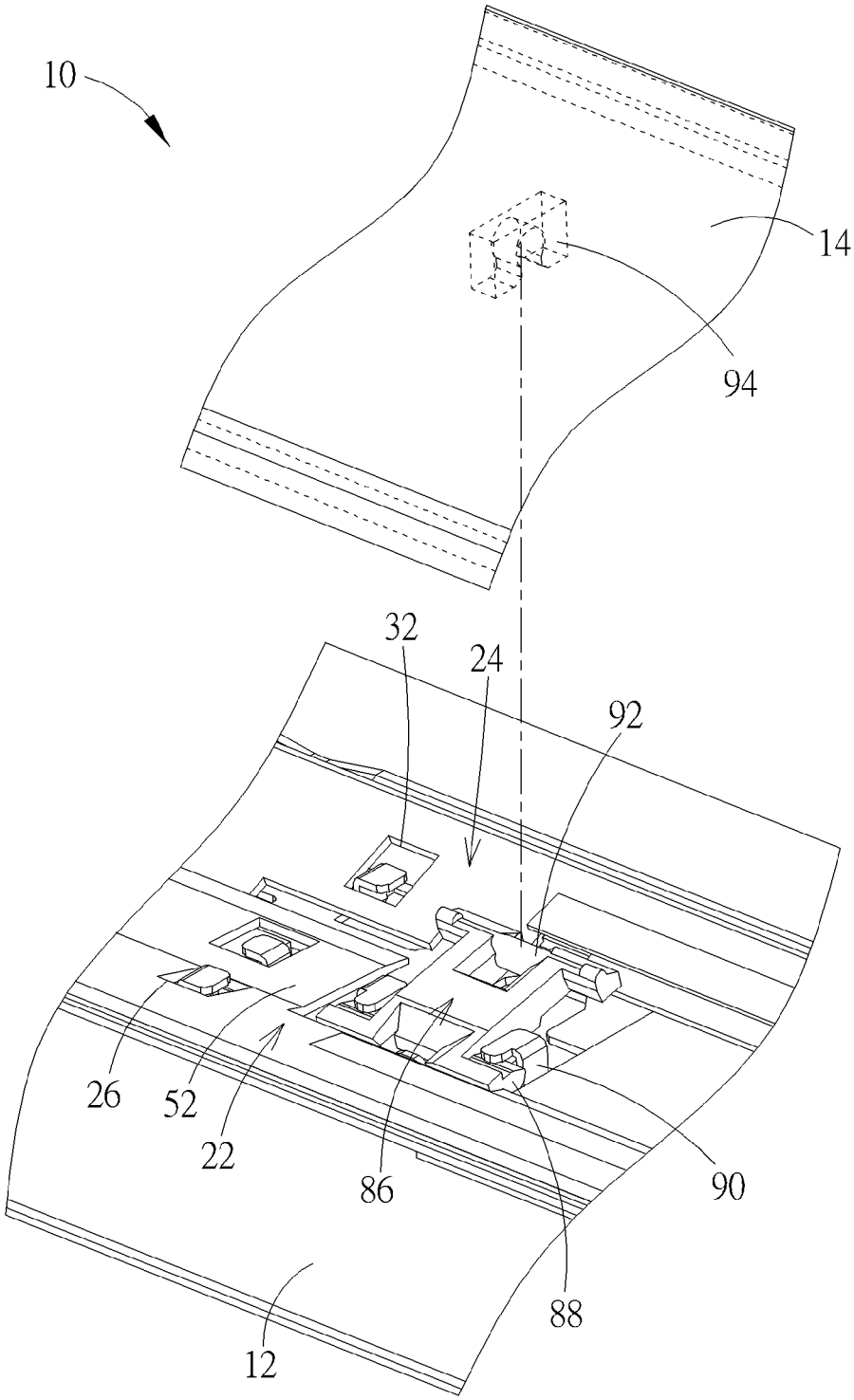
FIG. 6 is a partial enlarged exploded diagram of the keyswitch in FIG. 1.

In practical application, the keyswitch 10 could further adopt an auxiliary support to improve the motion steadiness of the cap 14. For example, please refer to FIG. 1 and FIG. 6. FIG. 6 is a partial enlarged exploded diagram of the keyswitch 10 in FIG. 1. As shown in FIG. 1 and FIG. 6, the keyswitch 10 could further include at least one auxiliary support 86 (two shown in FIG. 1, but not limited thereto). The auxiliary support 86 is disposed between the cap 14 and the base plate 12 and is alternately arranged with the support mechanism 20. The auxiliary support 86 could have a third engaging structure 88 corresponding to the base plate 12, and the base plate 12 could have a fourth engaging structure 90 corresponding to the third engaging structure 88. The third engaging structure 88 is engaged with the fourth engaging structure 90 (e.g. via the structural engagement design of the sliding portion (could be regarded as the third engaging structure 88) and the sliding slot (could be regarded as the fourth engaging structure 90) as shown in FIG. 6, but not limited thereto), to make the auxiliary support 86 movably connected to the base plate 12. Furthermore, the auxiliary support 86 could have a fifth engaging structure 92 corresponding to the cap 14 and the cap 14 could have a sixth engaging structure 94 corresponding to the fifth engaging structure 92. The fifth engaging structure 92 is engaged with the sixth engaging structure 94 (e.g. via the structural engagement design of the pivot portion (could be regarded as the fifth engaging structure 92) and the engaging slot (could be regarded as the sixth engaging structure 94) as shown in FIG. 6, but not limited thereto), to make the auxiliary support 86 movably connected to the cap 14.

Figure 7:
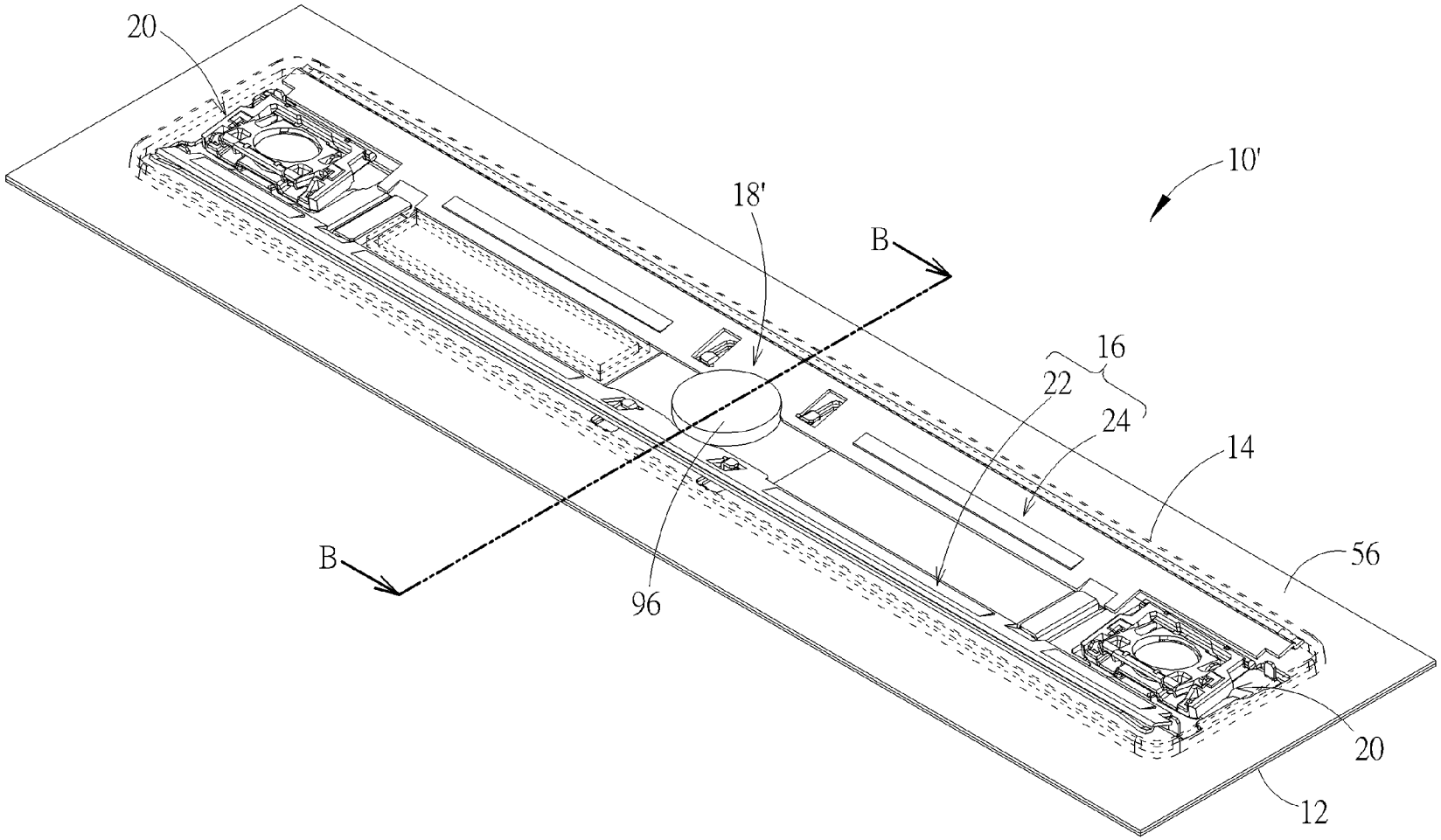
FIG. 7 is a diagram of a keyswitch according to another embodiment of the present invention.
Figure 8:
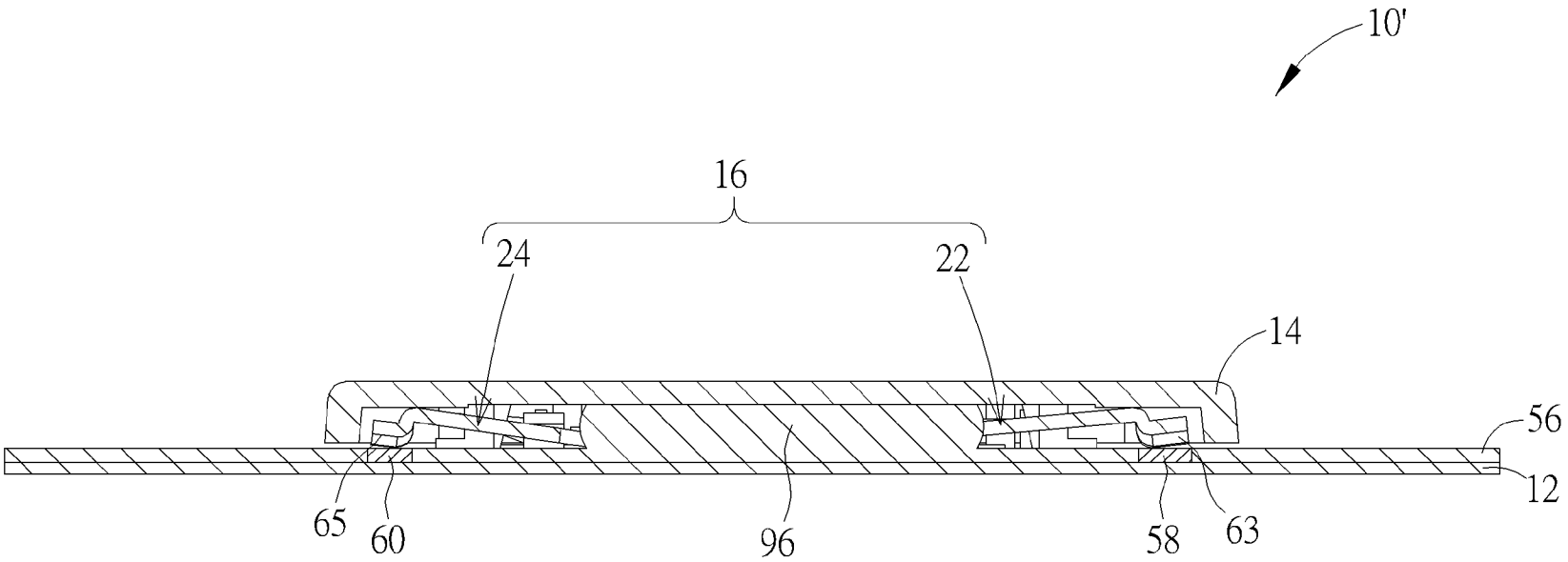
FIG. 8 is a cross-sectional diagram of the keyswitch in FIG. 7 along a cross-sectional line B-B when the cap is pressed.

It should be mentioned that the cap returning design adopted by the present invention is not limited to the aforesaid embodiment, meaning that the present invention could utilize a resilient member (e.g. rubber dome or spring) to provide the returning force in another embodiment. For example, please refer to FIG. 7 and FIG. 8. FIG. 7 is a diagram of a keyswitch 10' according to another embodiment of the present invention. FIG. 8 is a cross-sectional diagram of the keyswitch 10' in FIG. 7 along a cross-sectional line B-B when the cap 14 is pressed. For clearly showing the internal mechanical design of the keyswitch 10', the cap 14 is briefly depicted by dotted lines in FIG. 7. Components both mentioned in this embodiment and the aforesaid embodiment represent components with similar structures or functions, and the related description is omitted herein. As shown in FIG. 7 and FIG. 8, the keyswitch 10' includes a returning device 18', the base plate 12, the cap 14, the lifting mechanism 16, at least one support mechanism 20 (two shown in FIG. 7, but not limited thereto), and a membrane circuit board 56. In this embodiment, the returning device 18' could include a resilient body 96. The resilient body 96 could abut against the cap 14 and the base plate 12 respectively. Accordingly, when the external force is released, the compressed resilient body 96 pressed by the cap 14 (as shown in FIG. 8) could provide the returning force to the cap 14, to make the cap move from a pressed position as shown in FIG. 8 back to a non-pressed position as shown in FIG. 7 with the lifting mechanism 16, for generating the automatic cap returning effect.

Figure 9:
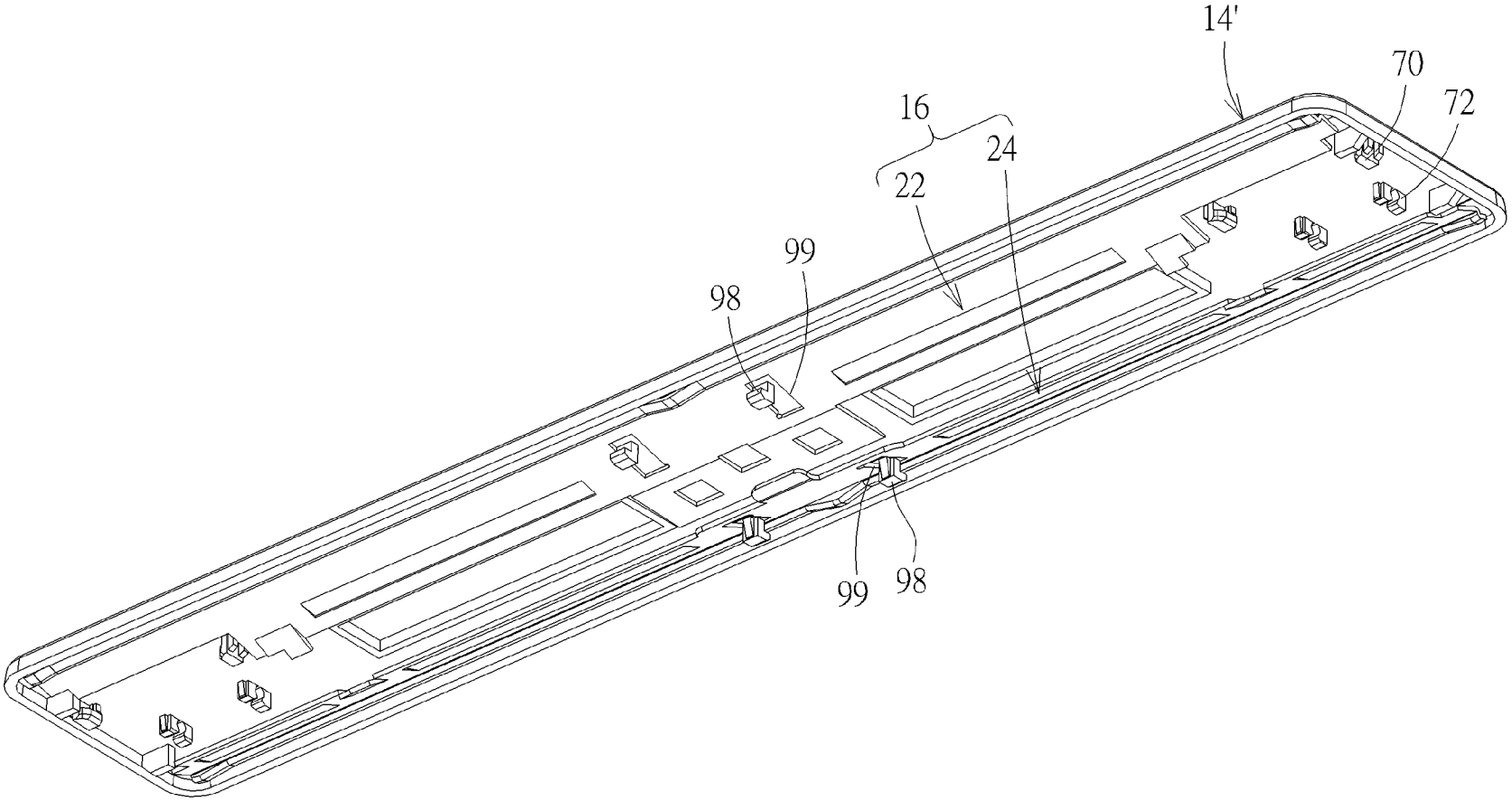
FIG. 9 is an assembly diagram of the cap, the first support plate and the second support plate according to another embodiment of the present invention.

Furthermore, please refer to FIG. 9, which is an assembly diagram of a cap 14', the first support plate 22 and the second support plate 24 according to another embodiment of the present invention. Components both mentioned in this embodiment and the aforesaid embodiment represent components with similar structures or functions, and the related description is omitted herein. As shown in FIG. 9, at least one first engaging structure 98 (two shown in FIG. 9, but not limited thereto) is formed on the cap 14', and the first support plate 22 has a second engaging structure 99 corresponding to the first engaging structure 98. To be more specific, in this embodiment, the first engaging structure 99 could preferably be a hook extending from the cap 14 toward the first support plate 22, and the second engaging structure 99 could correspondingly be an engaging hole formed on the first support plate 22. The first engaging structure 98 (i.e. the hook) is engaged with the second engaging structure 99 (i.e. the engaging hole) to constrain the deformation movement of the cap 14' relative to the first support plate 22, for preventing the cap 14' from being bulged due to uneven pressing force or stress concentration during the cap 14 is pressed. To be noted, the aforesaid design could also be applied to the second support plate 24 (as shown in FIG. 9), and the related description could be reasoned from analogy. Moreover, the present invention could prevent deformation of the cap via structural engagement of the cap and the base plate in another embodiment. That is to say, in another embodiment, a first engaging structure (e.g. the hook as shown in FIG. 9) could be formed on the cap, and the base plate could have a second engaging structure (e.g. the engaging hole as shown in FIG. 9) corresponding to the first engaging structure. Accordingly, the first engaging structure could be engaged with the second engaging structure for preventing deformation of the cap. As for related description for other derived embodiments (e.g. the first support plate has a hook formed thereon to be engaged with an engaging hole on the cap), it could be reasoned from analogy according to the aforesaid embodiments and omitted herein.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A keyswitch comprising: a base plate; a cap having a longitudinal axis; a lifting mechanism disposed between the base plate and the cap, the cap being movable between a pressed position and a non-pressed position via the lifting mechanism, the lifting mechanism comprising a first support plate and a second support plate coupled to each other, the first support plate having at least one first opening, the base plate being coupled to the at least one first opening to make the first support plate movably connected to the base plate, the first support plate having a first edge and a second edge, the first edge abutting against the base plate, the second edge being opposite to the first edge and abutting against the cap, the first edge and the second edge being parallel to the longitudinal axis, the second support plate having at least one second opening, the base plate being coupled to the at least one second opening to make the second support plate movably connected to the base plate, the second support plate having a third edge and a fourth edge, the third edge abutting against the base plate, the fourth edge being opposite to the third edge and abutting against the cap, the third edge and the fourth edge being parallel to the longitudinal axis; a returning device located between the first support plate and the second support plate for providing a returning force to drive the cap to move from the pressed position back to the non-pressed position with rotation of the first support plate relative to the base plate via the first edge and rotation of the second support plate relative to the base plate via the third edge; and at least one support mechanism located between the first support plate and the second support plate, the at least one support mechanism having a first support member and a second support member, the first support member being movably connected to the cap and the base plate, the second support member being movably connected to the cap and the base plate and being pivoted to the first support member; wherein the first edge has a first middle section and a first tail section, the first middle section is close to a center point of the longitudinal axis, the first tail section is close to a terminal point of the longitudinal axis, the third edge has a second middle section and a second tail section, the second middle section is close to the center point of the longitudinal axis, the second tail section is close to the terminal point of the longitudinal axis, the first tail section is away from the second tail section to form a containing space, and the support mechanism is disposed in the containing space.

2. The keyswitch of claim 1, wherein the first support plate further has a containing slot and an auxiliary edge corresponding to the support mechanism, the support mechanism is partially contained within the containing slot, and the auxiliary edge extends outwardly from the containing slot to be located at an outer side of the support mechanism away from the returning device and to abut against the base plate to make the first support plate rotatable relative to the base plate via the first edge and the auxiliary edge.

3. The keyswitch of claim 1, wherein the returning device includes a first magnetic member and a second magnetic member, the first magnetic member extends from the first edge toward the second support plate, the second magnetic member is disposed on the base plate corresponding to the first magnetic member, the first magnetic member magnetically attracts the second magnetic member to generate the returning force; when the cap is not pressed, the returning force keeps the cap at the non-pressed position; when the cap is pressed by an external force to make the first magnetic member separate from the second magnetic member with rotation of the first support plate relative to the base plate via the first edge, the cap moves from the non-pressed position to the pressed position with the lifting mechanism; when the external force is released, the returning force makes the first magnetic member approach the second magnetic member to make the cap move from the pressed position to the non-pressed position with the lifting mechanism.

4. The keyswitch of claim 1, wherein the returning device comprises a resilient body, and the resilient body abuts against the cap and the base plate respectively for providing the returning force to the cap.

5. The keyswitch of claim 1, wherein at least one first engaging structure is formed on the cap, one of the first support plate, the second support plate and the base plate has a second engaging structure corresponding to the at least one first engaging structure, and the at least one first engaging structure is engaged with the second engaging structure for preventing deformation of the cap.

6. The keyswitch of claim 5, wherein the at least one first engaging structure is a hook extending from the cap toward the one of the first support plate, the second support plate and the base plate, the second engaging structure is an engaging hole formed on the one of the first support plate, the second support plate and the base plate, and the hook is engaged with the engaging hole for preventing deformation of the cap.

7. The keyswitch of claim 1, wherein the keyswitch further comprises at least one auxiliary support, the at least one auxiliary support is disposed between the cap and the base plate and is alternately arranged with the support mechanism, the at least one auxiliary support has a third engaging structure corresponding to the base plate, the base plate has a fourth engaging structure corresponding to the third engaging structure, and the third engaging structure is engaged with the fourth engaging structure to make the auxiliary support movably connected to the base plate.

8. The keyswitch of claim 7, wherein the at least one auxiliary support has a fifth engaging structure corresponding to the cap, the cap has a sixth engaging structure corresponding to the fifth engaging structure, and the fifth engaging structure is engaged with the sixth engaging structure to make the auxiliary support movably connected to the cap.

9. The keyswitch of claim 1, wherein the cap has a first sliding slot and a first engaging slot, the base plate has a second sliding slot and a second engaging slot, the first support member has a first sliding portion and a first pivot portion, the first sliding portion is slidably disposed in the first sliding slot, the first pivot portion is rotatably connected to the second engaging slot, the second support member has a second sliding portion and a second pivot portion, the second sliding portion is slidably disposed in the second sliding slot, and the second pivot portion is rotatably connected to the first engaging slot.

10. The keyswitch of claim 1, wherein the keyswitch further comprises a membrane circuit board, the membrane circuit board is disposed on the base plate and has at least one first triggering switch corresponding to the second edge and at least one second triggering switch corresponding to the fourth edge, and when the cap is pressed to the pressed position, the second edge and the fourth edge trigger the at least one first triggering switch and the at least one second triggering switch respectively.

11. The keyswitch of claim 10, wherein the second edge has at least one first bending structure, the at least one first bending structure has at least one first protruding portion corresponding to the at least one first triggering switch, the fourth edge has at least one second bending structure, the at least one second bending structure has at least one second protruding portion corresponding to the at least one second triggering switch, and when the cap moves to the pressed position relative to the base plate via the lifting mechanism, the at least one first protruding portion presses the at least one first triggering switch and the at least one second protruding portion presses the at least one second triggering switch for triggering the membrane circuit board.

* * * * *